US005252942A

United States Patent [19]

Gurevich

[11] Patent Number: 5,252,942

[45] Date of Patent: Oct. 12, 1993

[54] FUSE LINKS AND DUAL ELEMENT FUSE

[75] Inventor: Leon Gurevich, St. Louis, Mo.

[73] Assignee: Cooper Industries, Inc., Houston, Tex.

[21] Appl. No.: 817,759

[22] Filed: Jan. 8, 1992

[51] Int. Cl.[5] ..... H01H 85/04

[52] U.S. Cl. ..... 337/163; 337/159; 337/164; 337/295

[58] Field of Search ..... 337/163, 164, 165, 166, 337/158, 159, 160, 161, 162, 290, 291, 292, 293, 294, 295, 401, 402, 416, 417

[56] References Cited

U.S. PATENT DOCUMENTS 5,077,534 12/1991 Douglass ..... 337/165

FOREIGN PATENT DOCUMENTS 777869 2/1968 Canada ..... 337/295
1325417 12/1963 France ..... 337/290
2262393 9/1975 France ..... 337/290

*Primary Examiner*—Harold Broome
*Attorney, Agent, or Firm*—Laff, Whitesel, Conte & Saret

[57] ABSTRACT

A hollow electrical circuit protector preferably coated with an insulative coating which will maintain its structure and not be conductive when said circuit protector blows. The electrical circuit protector has at least one weak spot cross-sectional area and is generally adapted to be part of a dual element fuse link with ribbon-like fuse links on opposite sides thereof. Also provided are the ribbon like fuse links, one with a guide and the other with an integral washer.

71 Claims, 8 Drawing Sheets

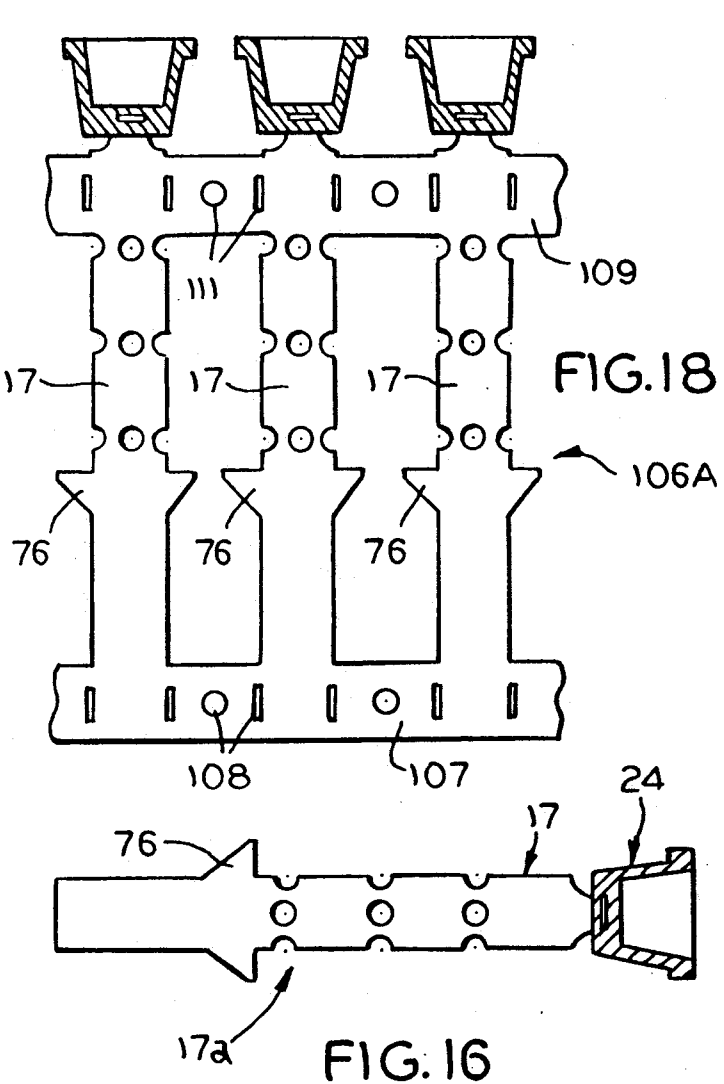
FIG. 18
FIG. 16
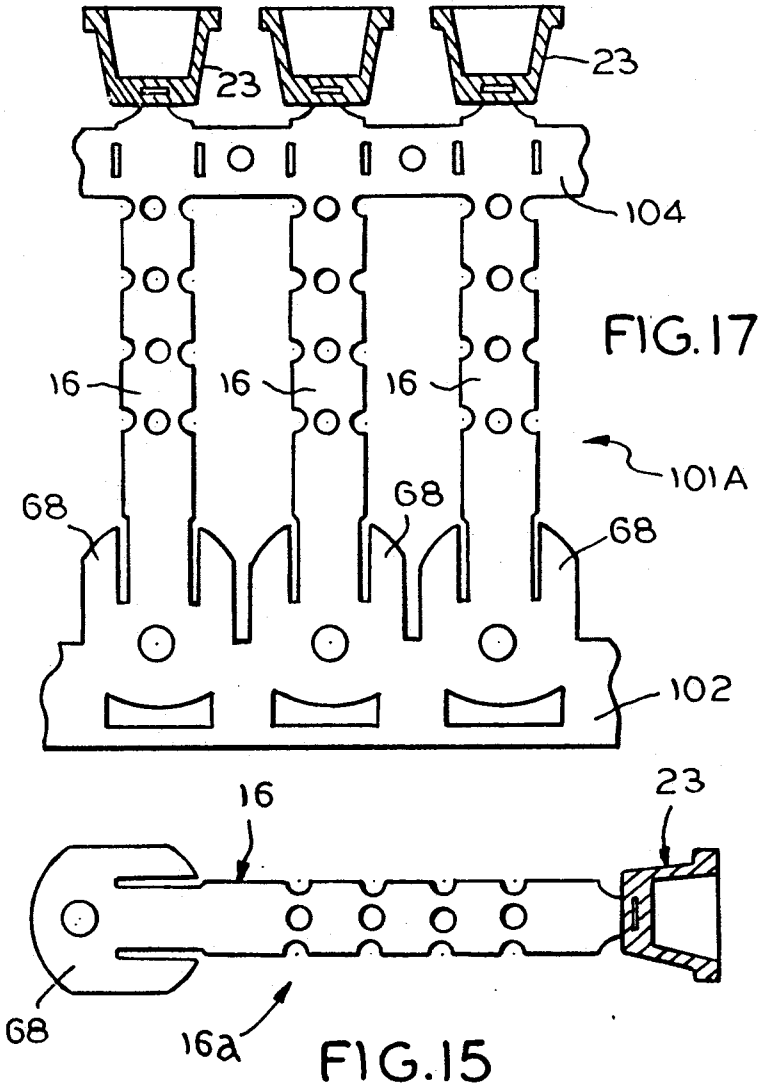
FIG. 17
FIG. 15

FUSE LINKS AND DUAL ELEMENT FUSE

BACKGROUND OF THE INVENTION

This invention relates to dual-element fuses, and more particularly, to a dual-element fuse having a hollow overload fuse link and to the substantially flat ribbon-like short circuit links.

As is well known, there are many examples of dual-element fuse links with at least one of the elements being utilized to open the fuse when there is a short circuit and another element being utilized to open the fuse when there is an overload.

The dual-element fuse normally has a mass of heat-softenable alloy which is in contact with a heat-absorbing element so that the softening of the mass of heat softenable alloy is delayed to provide a desired-predetermined, time-delay before the electric fuse responds to a relatively low, but potentially-harmful over current to effect opening of the circuit.

In some instances, the overload fuse portion is operated by a spring so that when the heat softenable material melts, the spring quickly opens the circuit. In these instances, the overload fuse element is usually maintained in air and is separated from any quartz sand or other material which is in the fuse element.

In other time delay fuses, the overload current is provided by a solid mass which is surrounded by sand. The sand acts as a heat conductor and allows the solid mass to melt. However, in such an instance, there are many times when the fuse does not blow due to the melting mass and sand acting as a conductor. These types of fuses are shown in U.S. Pat. No. 4,417,224 the Aeroflex Publication, U.S. Pat. No. 4,973,932. The reliability of these types of fuses while generally acceptable, still need improvements.

SUMMARY OF THE INVENTION

In view of the above, it is an object of this invention to provide a dual-element fuse which is capable of operating to interrupt high level currents and will respond to both large overloads and small overloads.

Therefore, we provide an electric circuit protector or fuse link which has a body defining an interior chamber or hollow interior. The circuit protector is usually prepared by casting or molding a mass of heat-softenable alloy. It is preferable that the circuit protector has at least one annular weak spot which allows the heat-softenable material to flow into the interior of the hollow body when the heat softenable material is melted and to thus open the circuit.

The hollow electric circuit protector is prepared to have structural integrity so that the circuit protector can provide the appropriate circuit opening upon melting.

The circuit protector is generally provided with a coating or housing in contact therewith which will maintain its structural integrity at the temperatures necessary to melt the overload fuse link. A preferred embodiment is a circuit protector having two conical halves with conical bores therein and being attached, i.e., welded or soldered, at their respective bases to provide the hollow body. It is preferred that the circuit protector be connected to electrical conducting means, i.e., short circuit links, at the opposite apexes and that the circuit protector has adjacent at least one of the apexes an annular weak spot.

Another object of the present invention is to provide a one-piece short-circuit fuse link being substantially flat and having integral therewith at one end a washer element, the other end being preferably tapered, and between the two ends are a plurality of weak spots.

It is still another object of the present invention to provide a substantially flat one-piece fuse link having a guide means. The guide means has small outer ends which are adapted to contact the inner surfaces of a cartridge fuse tube and said guide means being adjacent or spaced inwardly from one end. The other end of the fuse link is preferably a tapered end and there being a plurality of weak spots formed between the guide means and the other end.

Other and further objects and advantages of the present invention should become apparent from the drawings and the accompanying description wherein preferred embodiments of the present invention are shown and described.

BRIEF DESCRIPTION OF THE DRAWINGS

FIG. 15 is a partial cross-section of a partial fuse link attached to a short circuit fuse link;

FIG. 16 is a partial cross-section of a partial fuse link attached to another short circuit fuse link;

FIG. 17 shows a strip of the links of FIG. 14;

FIG. 18 shows a strip of the links of FIG. 16;

DETAILED DESCRIPTION OF THE INVENTION

Figure 1:
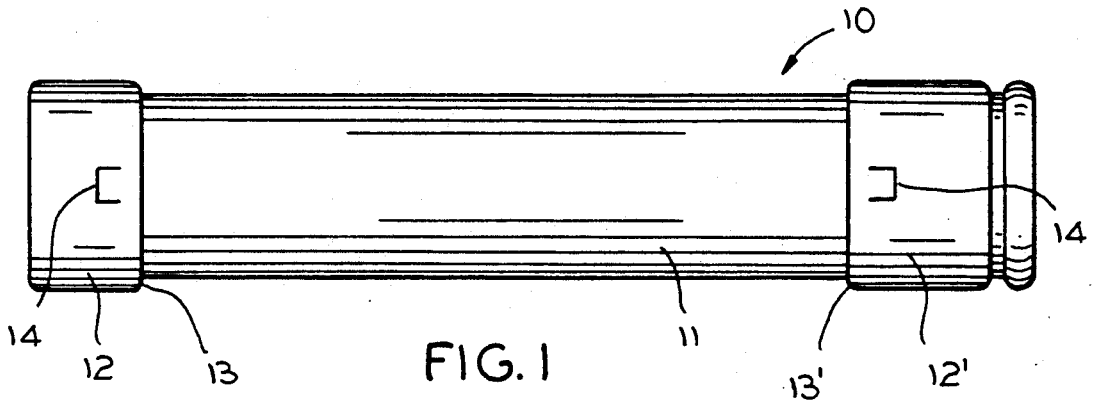
FIG. 1 is a side view of a typical cartridge fuse assembly.

Referring to FIG. 1, we show one preferred embodiment of the present invention which generally relates to a cartridge type fuse 10. The fuse 10 has a tubular casing 11. The casing 11 is generally made from a heat resistant insulating material such as fiber, paper, glass melamine, or the like. The casing 11 has on each end a ferrule-like terminal 12, 12' designed for the particular application. The ferrule terminals 12, 12' illustrated are generally made from brass or brass coated steel. The ferrule terminals 12, 12' are dimensioned to telescope over the proximal and distal ends respectively of the tubular casing 11. After the ferrule terminals have been placed on the tubular casing ends, their ends 13, 13' are crimped to hold them onto the casing. If desired, the terminals can also be notched at 14 to provide extra holding. The general external configuration for cartridge fuses such as 10 as shown in FIG. 1 is well known and relatively conventional.

Figure 2:
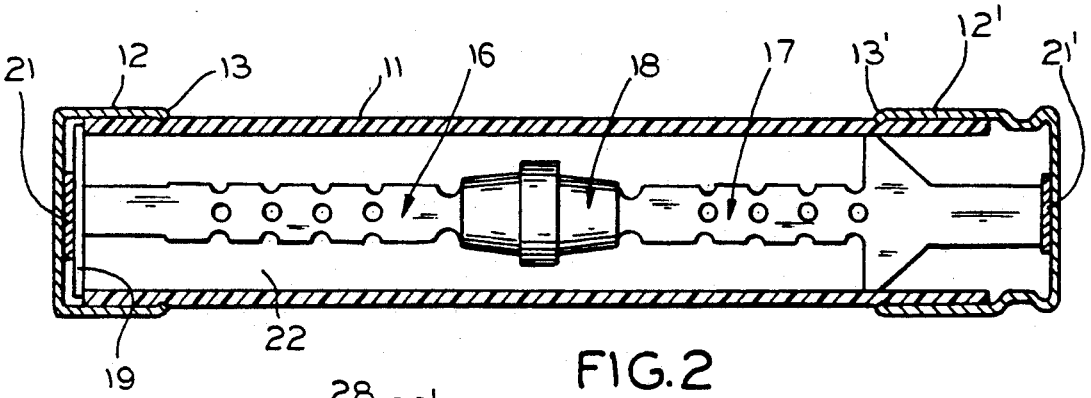
FIG. 2 is a partial cross-sectional view showing a fuse link assembly according to this invention.

FIG. 2 shows a cartridge fuse utilizing our invention. As noted above, cartridge fuses are only one aspect of our invention and our hollow fuse links are advantageously used in many areas where electrical circuit protection is needed. FIG. 2 shows a partial cross-sectional view of our dual element fuse link having two short circuit fuse link sections 16 and 17 and a hollow overload fuse link 18.

The fuse link sections 16 and 17 are appropriately attached to the proximal and distal ends of the hollow fuse link section 18 by molding or casting the appropriate ends of fuse link sections 16 and 17 onto the hollow fuse link section 18 while it is being molded or cast. The preferred method of preparing the fuse link is by injection molding.

The fuse link section 16 has a washer 19 electrically connected thereto. The washer 19 is soldered at 21 to the inner surface of the terminal 12 to electrically connect the fuse link section 16 to the terminal 12. The fuse link section 17 is electrically connected to the terminal 12' by soldering at 21' fuse link section 17 to the inner surface of the terminal 12'.

The fuse link sections 16, 17 and 18 may individually act as fuse links and/or circuit protectors, if desired. The term fuse link section, as used herein, is synonymous with fuse link.

The cartridge is filled with an appropriate filler 22, i.e, quartz sand. The sand 22 contacts each of the fuse links 16, 17 and 18. When the fuse link or circuit protector 18 is in the environment illustrated in FIG. 2, the fuse link 18 has an appropriate electrically insulating outer coating or shell to protect the fuse link 18 from being contacted by the filler.

Figure 3:
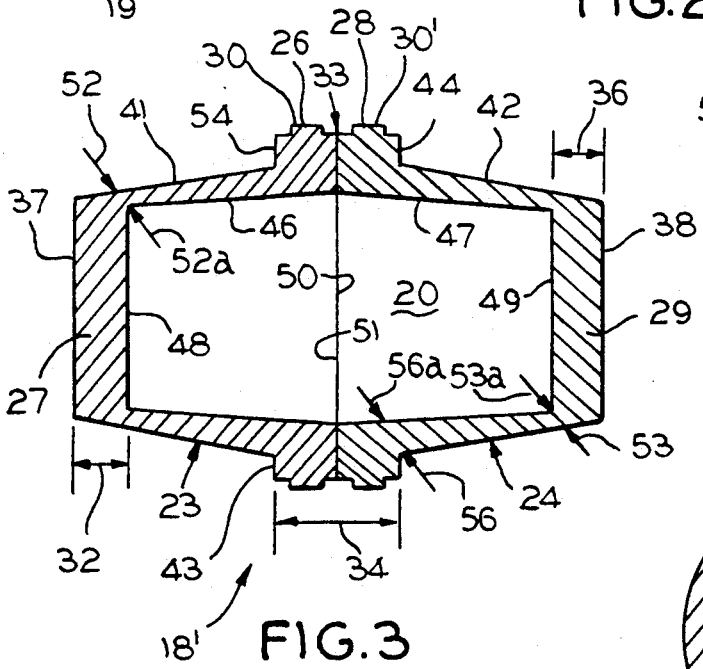
FIG. 3 is an enlarged cross-section view of a fuse link according to the present invention.
Figure 4:
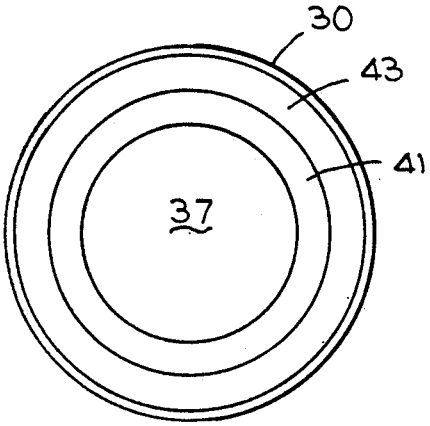
FIG. 4 is a left end-plan view of the fuse link of FIG. 4.

FIGS. 3 and 4 show a fuse link or circuit protector 18' without the outer insulating coating or shell.

The circuit protector or fuse link 18 is hollow. It has a body with outer walls enclosing and defining a chamber 20. One preferred construction of the fuse link or circuit protector 18' is shown in FIGS. 3 and 4 wherein a circuit protector 18' is generally constructed by appropriately joining two equal and symmetrical fuse link halves or sections 23 and 24 together. The two sections are preferably welded together.

Figure 30:
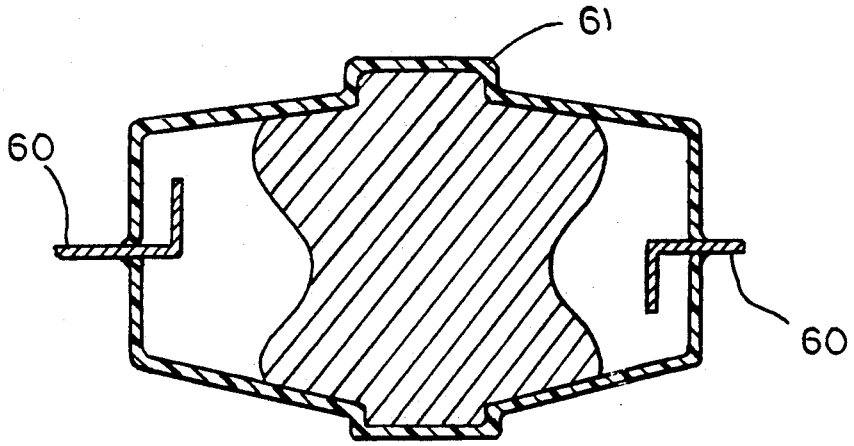
FIG. 30 shows the fuse of FIG. 2 in an open blown position.

The circuit protector 18 is preferably made from a solder composition and has therearound an insulative coating which will substantially maintain the outer shape of the circuit protector when the circuit protector opens to interrupt current passing therethrough, see FIG. 30. FIGS. 3–7 show circuit protector 18 without its insulative coating or housing therearound.

The circuit protector 18 is preferably prepared by molding two frustro-conical sections 23 and 24 having cylindrical bases 26 and 28 which protrude from the outer conical walls at one end. The frustro-conical sections 23 and 24 are joined at their cylindrical bases 26 and 28. The other ends of the sections 23 and 24 are flat apex ends 27 and 29 respectively.

The cylindrical bases 26 and 28 preferably have cylindrical flanges 30 and 30' approximately centered on the outer surface of the cylindrical bases 26 and 28.

The circuit protector 18' is preferably made of two frustro-conical sections 23 and 24 joined at their raised cylindrical bases 26 and 28 and having flat apex ends 27 and 29 respectively.

If desired, the circuit protector could have other desired outer shapes such as an egg shape, an egg shape with flat ends and a central raised body section, two cones joined at their bases, or any other shape with a hollow interior that will provide the circuit interruption desired.

The bases 26 and 28 provide a raised central body portion 33. The apex end 27 is referred to as the circuit protector proximal end and has a thickness 32. The thickness 32 is generally less than the width or thickness 34 of the central raised body portion 33. The apex end 29 is referred to as the circuit protector distal end and has a thickness 36 equal to the thickness of the proximal end 27.

The outer faces 37 and 38 of the proximal and distal ends 27 and 29 respectively are substantially circular and are substantially flat.

Figure 5:
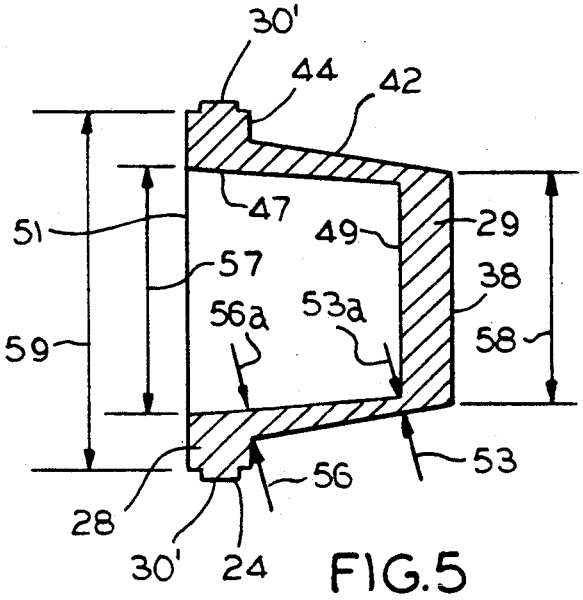
FIG. 5 is a cross-section view of half of the fuse link of FIG. 3.
Figure 6:
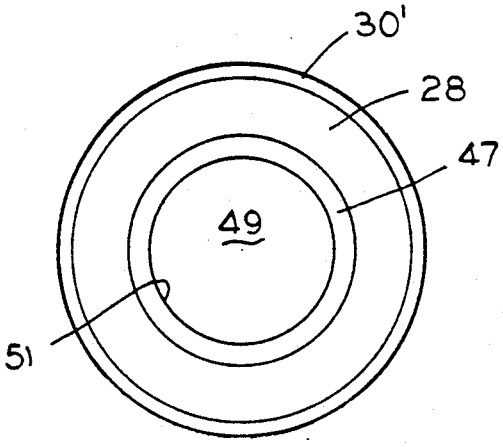
FIG. 6 is a left plan view of FIG. 5.
Figure 7:
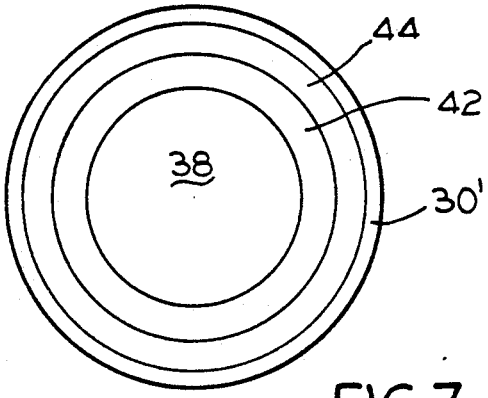
FIG. 7 is a right plan view of FIG. 5 and is the same as FIG. 4.

As noted above, the circuit protector halves 23 and 24 are identical and may be produced in the same mold or simultaneously in identical molds. FIGS. 5–7 show only circuit protector half 24.

The circuit protector halves 23 and 24 have outer conical surfaces 41 and 42 inclining from their respective apex ends 27 and 29 to their respective bases 26 and 28 to form oppositely facing annular shoulders 43 and 44 respectively.

The shoulders and cylindrical flanges aid in joining the two halves together—especially when the two halves are welded together.

With the conical shape as shown, the bases 26 and 28 have a larger outer diameter than the outer diameter of each apex. Each circuit protector half 23 and 24 are provided with frustro-conical bores 46 and 47 respectively. Generally, the base link halves are molded so that they have electrically connected and extending outwardly from ends 48 and 49 two appropriate electrical connections or other fuse links. The bores 46 and 47 have openings 50 and 51 respectively defined by the ends of the bases 26 and 28.

Preferably, the conical wall of the two halves 23 and 24 taper inwardly from the bases 26 and 28 respectively to provide two annular weak spots taken at points 52, 52*a*, and 53 and 53*a* respectively adjacent the inner surfaces 48 and 49 of the apex ends 27 and 29. In this embodiment, the thickness of the walls at the annular weak spots is less than the thickness of the walls adjacent the shoulders 43 and 44 respectively, as shown by points 54, 54*a* and 56, 56*a*.

The bores 46 and 47 of the halves 23 and 24 respectively are preferably frustro-conical with the diameter of the inner faces 48 and 49 being smaller than the diameter of their respective openings 50 and 51.

Figure 3A:
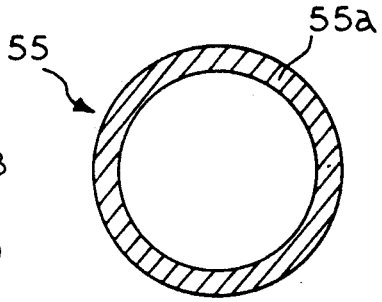
FIG. 3A is a cross-sectional view of a weak spot area of FIG. 3.

FIG. 3A shows the annular weak spot 55 of fuse link 18'. The weak spot is measured as the cross-sectional area 55*a*. The annular cross-sectional area 55*a* is determined by measuring the annular area taken along a tapered counter-bore line (not shown) drawn from a point 53, FIG. 3, on the outer surface 42 to a point 53*a* on the inner surface 47. The point 53*a* is at the junction of the inner face 49 and the inner side surface 47. The point 53 is spaced from the end face a distance along the outer surface substantially equal to the distance 36.

Figure 3B:
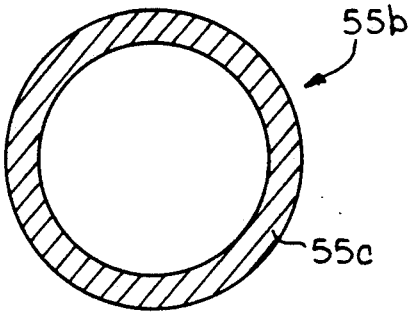
FIG. 3B is a cross-sectional view of a base area of FIG. 3.

FIG. 3B shows an annular fuse base ring 55*b* having an annular cross-sectional area 55*c*. The annular cross-section area 55*c* is determined by measuring the annular area taken along a beveled edge line (not shown) drawn from a point 56, FIG. 3, on the outer surface 42 to a point 56*a* on the inner surface 47. The point 56 is at the junction of the outer surface 47 and the shoulder 44. The point 56*a* is spaced from the opening 51 a distance along the inner surface 47 substantially equal to the outer width of the base 28.

The annular base cross-sectional area 55*c* is at least 1.75 times greater than the annular weak spot cross-sectional are 55*a*. The weak spot is generally the smallest cross-sectional are of the fuse link. The cross-sectional area of the weak spot for a hollow fuse link is generally compared with the largest cross-sectional area of the fuse link taken along a hollow portion.

The diameter 57 of the bore opening is preferably larger than the diameter 58 of the outer apex face 38. The shoulder 28 helps prevent the fuse link or circuit protector from collapsing and therefore, the larger the diameter 59, the less chance there is of having the circuit protector 18' from collapsing. The size of 59 is generally dependent on spacing. For instance, in the cartridge fuse of FIG. 2, the diameter 59 of base 28 must be smaller than the internal diameter of the fuse tube 11. The fuse link 18 is preferably spaced from the interior of the tube 11.

Figure 8:
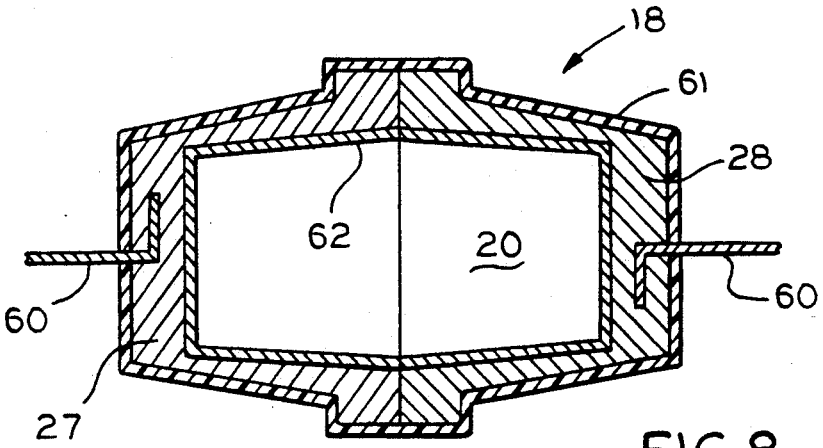
FIG. 8 is a partial cross-section view of a fuse link according to the present invention.

FIG. 8 shows a partial cross-section of the fuse link 18 and cut away sections of an electrical connection 60 on each end of the fuse link 18. The fuse link 18 is coated with an insulation coating 61. The insulation coating entirely surrounds the outer surface of fuse link 18 and the coating is adhered to the electrical connections 60. The coating is used to protect fuse link 18 from coming into contact with the filler 22.

Also, prior to joining the two halves 23 and 24 both interiors are coated with a relatively dry flux material. The thickness of the flux coating as shown in FIG. 8 is not for dimensional purposes but only for illustration.

The solder alloy used to produce the hollow fuse links has a low lead content, preferably is eutectic with a narrow melting point band of up to 8° C. The melting point of the solder is from about 90° C. to about 150° C. with from about 130° C. to 140° C. being preferred. The solder is electrically conductive, has low electrical resistance and contain less than 2% to 5% lead and preferably from about 0% to about 2% lead and most preferably 0% lead. The solder is preferably an indium bismuth, antimony, zinc, cadmium or tin based solder with tin, bismuth, antimony and zinc based eutectic solders being preferred. Also, the solder must be able to be molded or cast and not be brittle after casting and relatively neutral to casting expansion and also have low thermal expansion.

Alloys which have acceptable properties are the bismuth and tin alloys which contain from about 35% to about 60% by weight bismuth and from about 65 to about 40% by weight tin, from about 0% to 6% by weight zinc, and from about 0% to about 2% by weight lead.

A preferred solder alloy is one having about 56% by weight bismuth, about 40% by weight tin, and about 4% by weight zinc The external coating 61 has been chosen to provide sufficient thermal resistance so that it will not melt, to be substantially rigid at about 150° C. and less, and preferably substantially rigid at least about 160° to 170° C. The coating also is relatively strong, resists vibration caused by the use of the fuse, is relatively inert to the environment of its intended use and is relatively non-electrically conductive even when it comes into contact with or close to electrical arcing.

A preferred coating is one which can be easily applied in its liquid state and hardened in less than about one minute A preferred coating is a silicone rubber coating Q3-6662 purchased from Dow Corning Company. This silicone coating has the following preferred properties: liquid at room temperature, a wetting angle of more than 120°, a Viscosity of between about 2500 to about 3500 cps, self bridging tension characteristics, hardens with less than 30 sec UV exposure, and is non-conductive when exposed to arcing and does not thermally react to heat.

The flux coating prevents the oxidation of the solder and is operational below the melting of the solder. The flux dissolves sufficient oxides formed Solder oxides have a tendency to prevent the melting of the solder at its desired melt temperature and therefore would interfere with the reliability of the fuse link 18. The flux is dissolved in a non-volatile agent and does not burn or disintegrate below about 150° C. A preferred flux is rosin dissolved in pure pine oil. Other suitable fluxes may be utilized such as rosin, with poly solve and triethanolamine diluted with water.

Other bismuth and tin solder fluxes such as Kestner Company #1544 or Alpha Metals, Inc. # Alpha 711 may be used.

Figure 9:
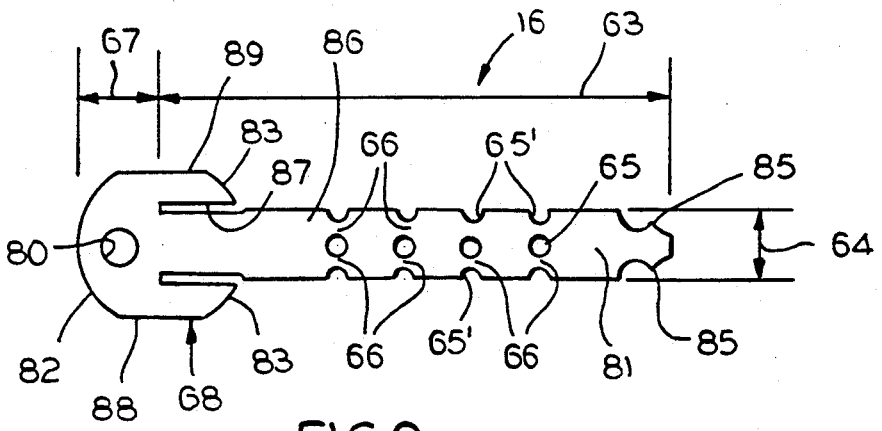
FIG. 9 is a top plan view of a short circuit fuse link of the present invention.
Figure 10:
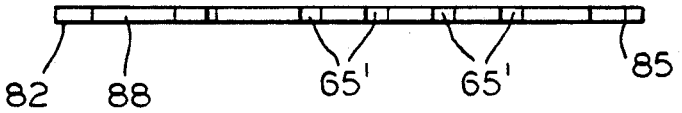
FIG. 10 is a side view of the fuse link of FIG. 9.

The fuse link 18 is generally used in dual element fuses to provide current overload protection Also, in these dual element fuses, as shown in FIG. 2, there are short circuit protectors 16 and 17. Referring to FIG. 3, there is shown a continuous strip 101 having a plurality of interconnected fuse links 16. This strip is prepared by continuously feeding a rolled sheet of metal through a series of stamping stations to produce a strip containing a plurality of fuse links 16. The fuse links 16 in the strip are interconnected at adjacent washers 68 by feed connections 102 having feed apertures 103. They are also interconnected below the tapered ends and above the first weak spot aperture 65 by feed connections 104 having feed apertures 105. The feed connections 102 and 104 are removed from the strips to prepare individual links 16 as shown in FIGS. 9 and 10. Referring to FIGS. 9 and 10 the individual short circuit fuse link 16 have a length 53 and a width 64. For an RK-5 type fuse as illustrated in FIG. 2, the length 63 is at least three times the width 64. The link 16 has a plurality of weak spots 66 formed along the length thereof. The weak spots 66 are formed by the apertures 65 and partial apertures 65'. The apertures 65 are spaced along the longitudinal axis of the link 16 and the partial apertures 65' at the top and bottom edges of the link 16. For each aperture 65 there is an aligned top and bottom partial aperture 65'. The partial apertures 65' act to prevent or restrain the arc from running up or along the edge of the link.

Figure 9A:
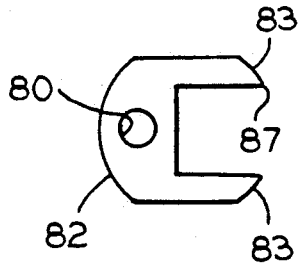
FIG. 9A is an end view of FIG. 9.

On the proximal end of the fuse link 17 is formed an integral washer 68. In operation, the washer 68 is bent approximately along its center line to extend substantially perpendicular to the fuse link, longitudinal axis 81 An end view of the bent washer is shown in FIG. 9A. The washer 68 is advantageously used to eliminate the need for a separate washer. Also, the washer has a diameter that is larger than the internal diameter of the fuse tube 11 and is adapted to rest on the fuse tube. The diameter is less than or equal to the internal diameter of ferrule terminal 21. The washer has a radius 67 greater than the width 64 of the fuse link. The washer is constructed so as to have two opposing arcuate sides 82 and 83. The arcuate side 83 has a slot 87 extending from the periphery of the washer side 83 to slightly beyond the center of the washer 68. The slot 87 has substantially parallel sides which extend substantially parallel to the longitudinal axis 21. The width of the slot is slightly greater than the width 64 of the link. The portion of the link adjacent the washer as shown in FIG. 9 has a width slightly less than the width 64 of the link 16.

The washer also has two opposing generally straight parallel sides 88 and 89. The sides 88 and 89 are generally parallel to the longitudinal axis 81 and join the arcuate sides 82 and 83 of the washer. The washer as shown in end view has an opening 80 and this opening along with the slot opening are used to fill the fuse with quartz sand. This construction also allows the washer to be soldered to the ferrule terminal 21 in a more efficient manner. The fuse link 16 and washer 58 combination is one piece and generally or substantially flat ribbon-like fuse link.

The distal end of the fuse link has reduced width portion which is shown as being tapered The tapered distal end has on the top and bottom edges thereof solder gripping points 85 which help hold the fuse strip onto the fuse link 18.

In a preferred embodiment, at least a portion of the fuse link distal end is generally bent at right angles to the face of the fuse link face 86. The distal end is cast o molded onto the proximal end 27 of the fuse link 18 to provide the angle connection shown in FIG. 8.

Figure 14:
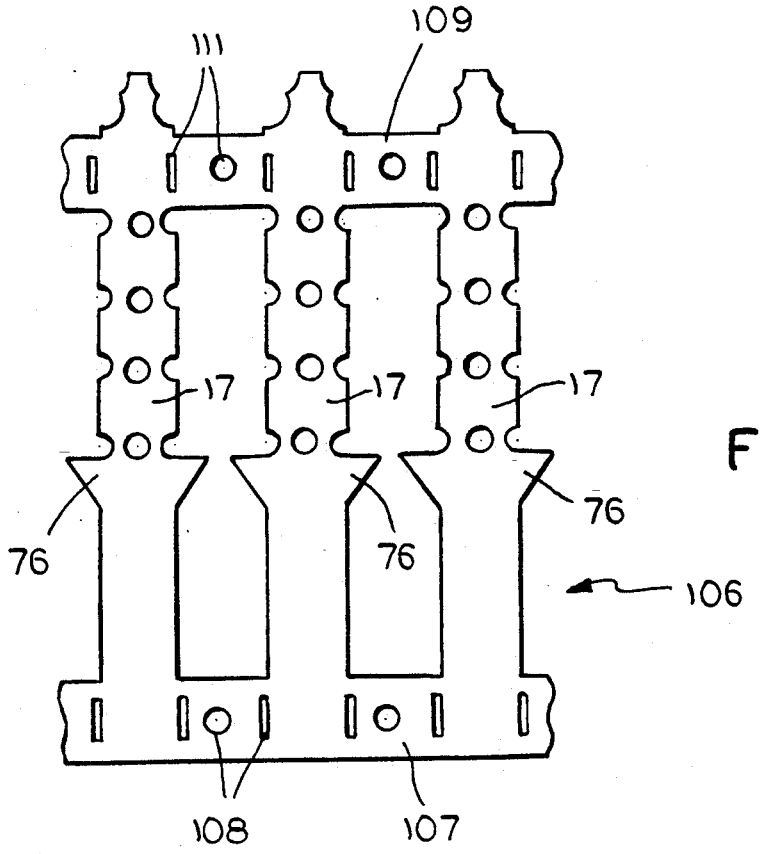
FIG. 14 is a top view of a one-piece strip having a plurality of other fuse links.
Figure 19:
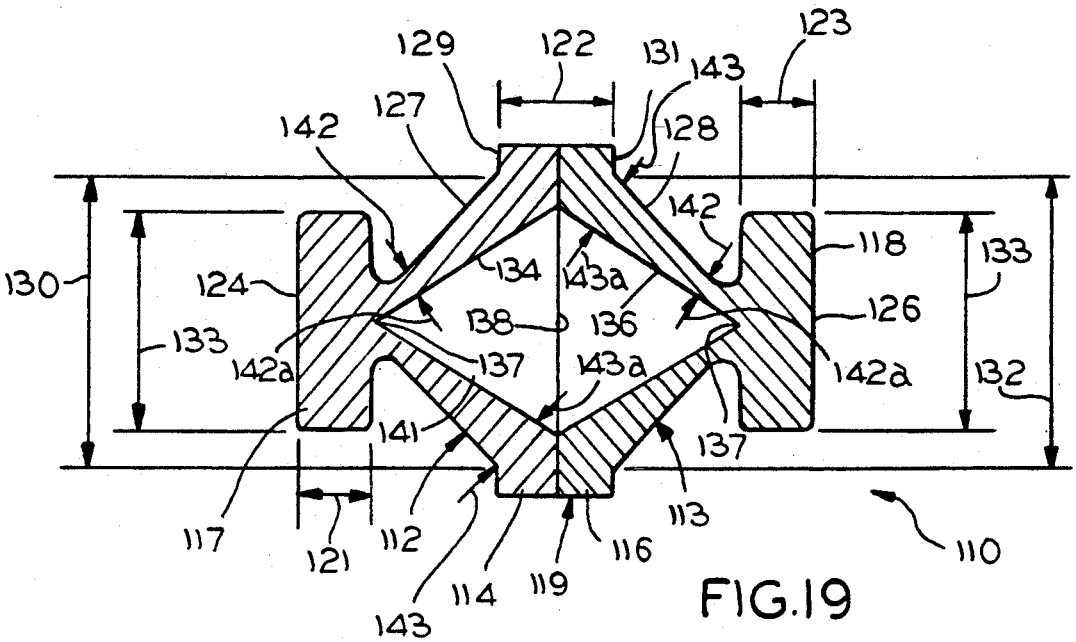
FIG. 19 is a cross section of another type of fuse link of the present invention.

Referring to FIG. 14, there is illustrated a continuous strip 106 of fuse links 17. The strip 106 is prepared in a similar manner as strip 101 and the strip containing the plurality of interconnected fuse links 17 is stamped from a roll of metal sheet. The fuse links 17 are interconnected at their distal ends by feed connectors 107 having feed apertures 108 and below the guide 76. They are also interconnected below their tapered ends and above the first weak spot aperture 65 by feed connectors 109 having feed apertures 111. The feed connectors 107 and 109 are removed from the strips to prepare individual links 17.

Figure 11:
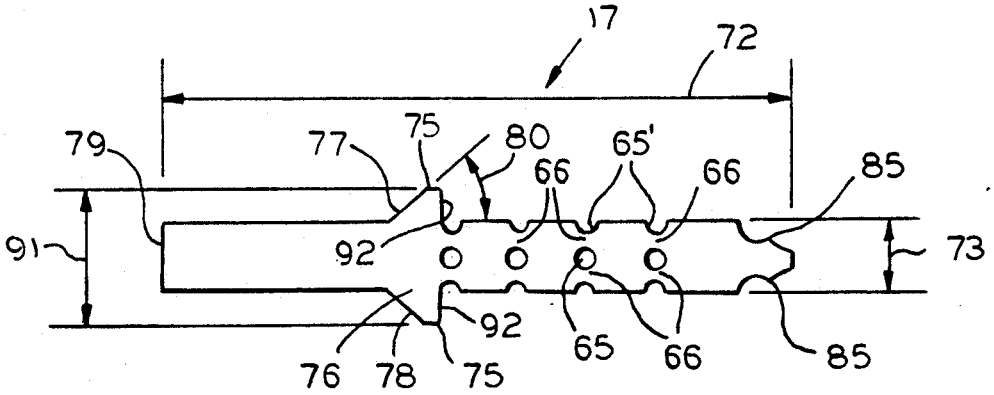
FIG. 11 is a top plan view of another short circuit fuse link of the present invention.
Figure 12:
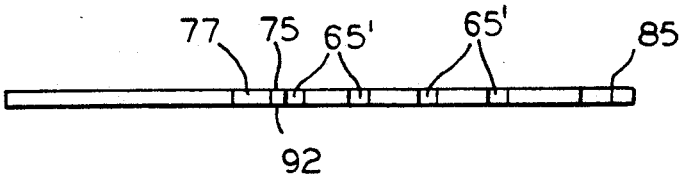
FIG. 12 is a side view of the fuse link of FIG. 11.
Figure 13:
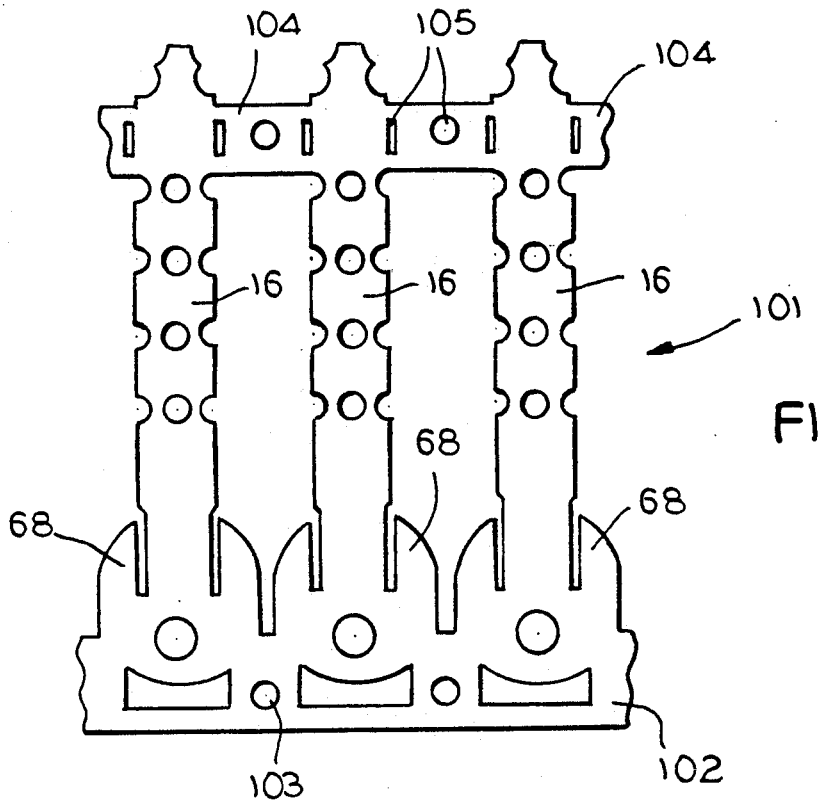
FIG. 13 is a top view of a one piece strip having a plurality of fuse links.

Referring to FIGS. 11 and 12, there is provided another short circuit fuse link 17 having a tapered distal end similar to the distal end of link 16. The fuse link 17 is also a generally or substantially one-piece fuse link having a length 72 and a width 73. For RK-5 type fuses, the length 72 is generally greater than 3 times the width 73. The fuse link has a plurality of weak spots 66 formed by apertures 65 and partial apertures 65'. Generally, the width 73 of fuse link 17 is equal to the width 64 of fuse link 16 and the size of the weak spots 66 of both fuse links 16 and 17 are equal.

Spaced inwardly from the proximal end 79 of fuse link 17 is formed an integral guide means 76. The guide 76 is formed by two sides 77 and 78 diverging from the top and bottom edges respectively of the fuse link 17. The side walls 77 and 78 diverge relative to the top and bottom edges at an angle 80. The angle 80 is from about 30° to about 60°. The diverging walls 77 and 78 join a pair of generally parallel straight walls 75, 75'. The straight walls 75 extend to the guide end walls 92. The distance 91 between the end walls 75, 75' is approximately equal to the inner diameter of the tube 11, FIG. 2. The guide 76 as hereinafter set forth is used in one of our methods of assembling the cartridge fuse.

The short circuit fuse links 16 and 17 of the present invention are relatively strong so that they can be freely inserted into cartridges and filled with sand without damaging the links. The strip and links therefore have an appropriate thickness. The guide and washer as stated above aid in this.

The thickness for the RK-5 type fuses is generally not less than 0.004 inches and is from about 0.004 to about 0.013 inches. The metal is annealed and has a hardness to allow for stamping the desired shape.

The short circuit strips 16 and 17 ar designed to conduct heat to the overload fuse link 18. Therefore, our fuse links 16 and 17 have a generally high electrical resistance and a relatively high thermal conductivity and are made from the appropriate alloys. Appropriate alloys are copper alloys such as commercial bronze, copper-nickel or red brass. A preferred alloy is red brass which has about 85% by weight copper and about 15% by weight zinc.

The fuse links 16 and 17 are constructed to insure reliable overload interruption so that heat generated by the weak spots 66 in the links 16 and 17 are conducted through the links 16 and 17 and not through the sand or filler.

Figure 22:
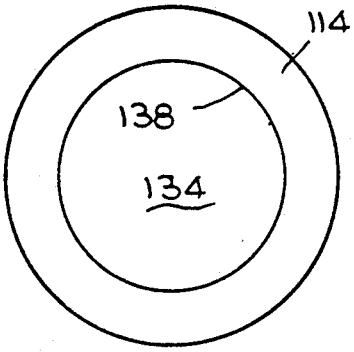
FIG. 22 is a right plan view of FIG. 25.
Figure 23:
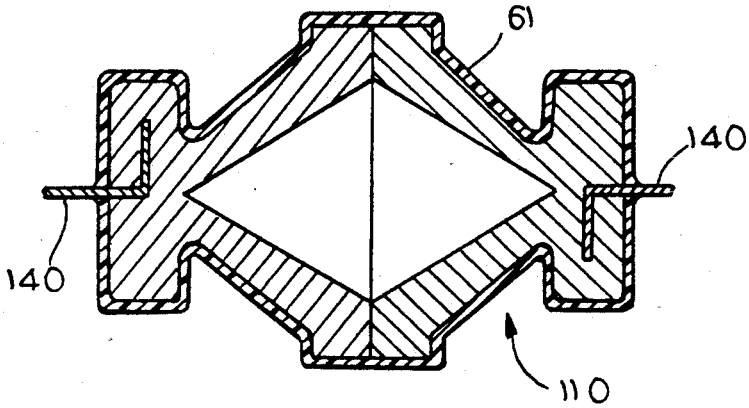
FIG. 23 is a partial cross-section of a dual element fuse link using the link of FIG. 19.

Referring to FIGS. 22 and 23, there is shown an overload fuse link 110, preferably made of two conical sections 112 and 113 joined at their raised cylindrical bases 14 and 116 and having substantially solid cylindrical apexes 117 and 118 respectively.

The cylindrical bases 114 and 116 may have cylindrical flanges (not shown) if desired. The raised bases, when joined, provide a raised central body portion 119. The apex end 117 is referred to as the fuse link proximal end and has a thickness 121. The thickness 121 is generally less than the width 122 of the raised central portion 113. The apex end 118 is referred to as the fuse link distal end and has a thickness 123 which is approximately equal to the thickness of the proximal end 117.

The outer faces 124 and 126 of the proximal and distal ends 117 and 118 respectively are substantially circular and are substantially flat. The circuit protector halves 112 and 113 are identical so that the fuse link 110 can be calibrated accurately.

Figure 20:
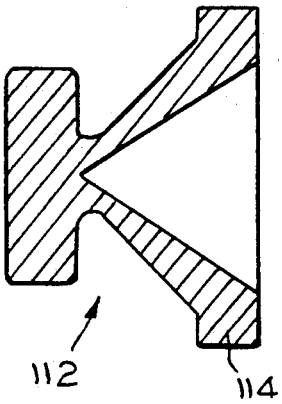
FIG. 20 is a cross-section of half of the fuse link of FIG. 19.
Figure 21:
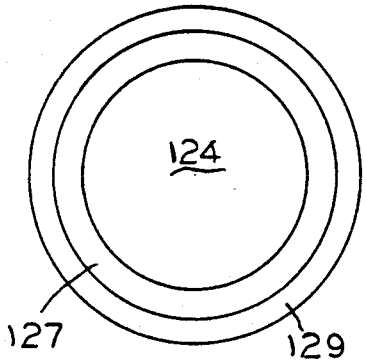
FIG. 21 is a left plan view of FIGS. 19 and 20.

FIGS. 20–22 show only the circuit protector half 112. The circuit protector halves 112 and 113 have outer conical surfaces 127 and 128 inclining adjacent their respective apex ends 124 nd 126 to their respective bases 114 and 116 to form oppositely facing annular shoulders 129 and 131. The outer diameters 131 of the conical walls 127 and 128. Where they join the shoulders 129 and 131 respectively is larger than the diameter 133 of the cylindrical apexes 124 and 126.

Each circuit protector half 112 and 113 has bores 134 and 136 respectively. The bores 134 and 136 have substantially closed apex ends 137 which generally meet the apex ends 117 and 118. The bores 134 and 136 have openings 137 and 138 which are joined together to form the hollow interior 141. Preferably, the conical walls 134 and 136 taper inwardly from the bases 114 and 116 respectively to provide two annular weak spot areas provided by the points 142 and 142*a* adjacent to the apexes 137. The thickness of the walls at the points 142 and 142*a* is less than the thickness of the base 143 and 143*a*. preferably, the annual weak spot cross-sectional area formed by counter bore area taken along a line (not shown) connecting points 142 and 142*a* is at least two times the cross-sectional area formed by the tapered annular line (not shown) connecting points 143 and 143*a*.

FIG. 23 shows a partial cross section of the fuse link 110 and cut-away sections of an electrical connection 140 on each end of the fuse link 110. The fuse link 110 is composed of a coating 61 entirely surrounding the electrical conductor fuse link 110 and being adhered to the electrical connections 150. Also, there is preferably an internal coating of a flux material.

Figure 24:
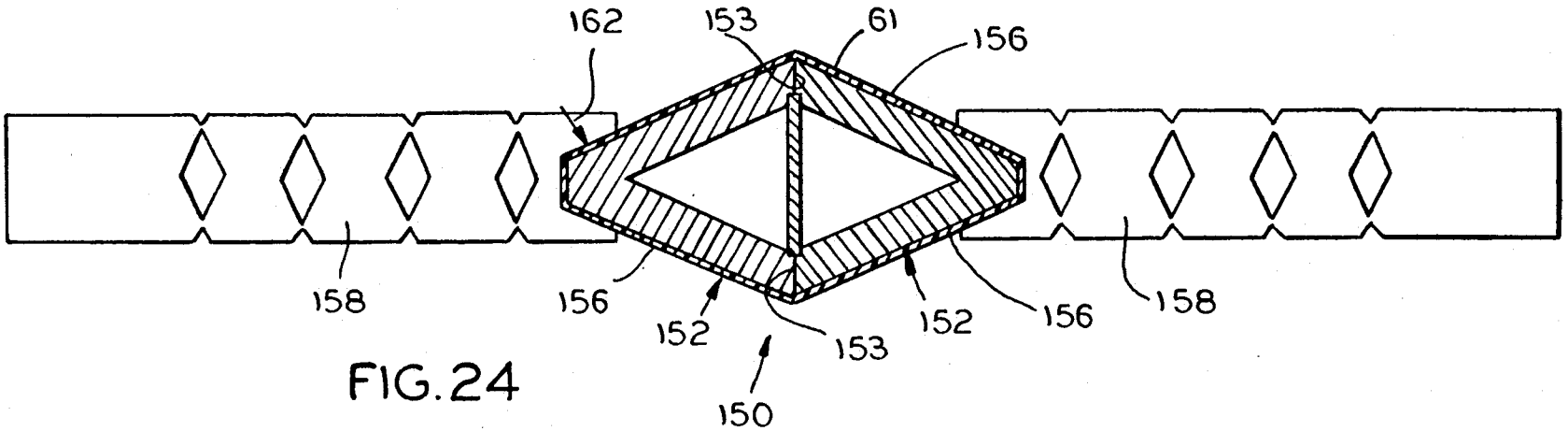
FIG. 24 is a partial cross-section of another dual element fuse link of the present invention.

FIG. 24 shows another configuration of a fuse link having an overload fuse link 150. The fuse link 150 is preferably made of two equal conical sections 152 being joined at their bases 153. The conical sections 152 each have a conical bore 154 with side walls substantially parallel to the outer walls of the fuse link 150. The fuse link 150 has an outer coating 61 totally surrounding the fuse strip and adhered to a portion of the fuse links 158 which are attached to each apex end of the fuse link 150.

The fuse link 150 also has an internal flux coating 62.

Figure 25:
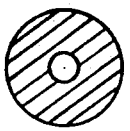
FIG. 25 is a cross-section view of weak spot areas of the link of FIG. 24.

FIG. 25 shows the annular weak spot 160 of fuse link 150. The fuse link 150 has a support structure i.e. washer means 155 mounted in the chamber between the conical bores 152. The washer has a diameter larger than the base diameter of the conical bores 152. The weak spot 150 is measured by the cross-sectional area 161. The cross-sectional area is determined by measuring the annular area taken along the tapered counter-bore line (not shown) drawn approximately from points 162 and 162*a*.

Figure 26:
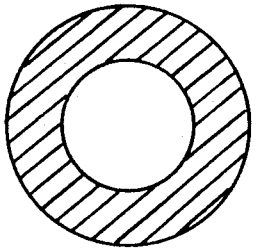
FIG. 26 is a cross-sectional view of a base area of the link of FIG. 24.

FIG. 26 shows the annular base ring 163 having an annular base cross-sectional area 164 adjacent the base. The annular area 164 is measured by the annular tapered area taken along a tapered edge line (not shown) drawn approximately from points 166 and 166*a*.

Figure 27:
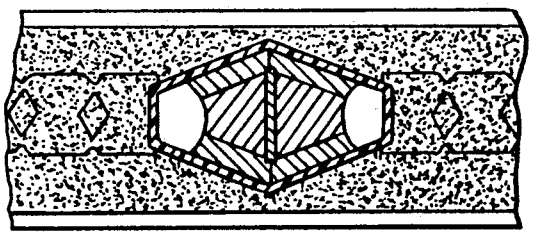
FIG. 27 shows the fuse of FIG. 24 in an open blown position.
Figure 28:
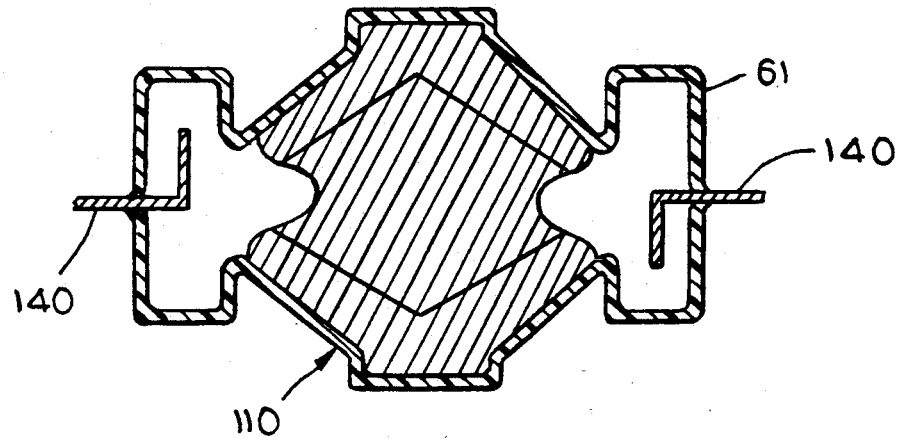
FIG. 28 shows the fuse of FIG. 23 in an open position.
Figure 29:
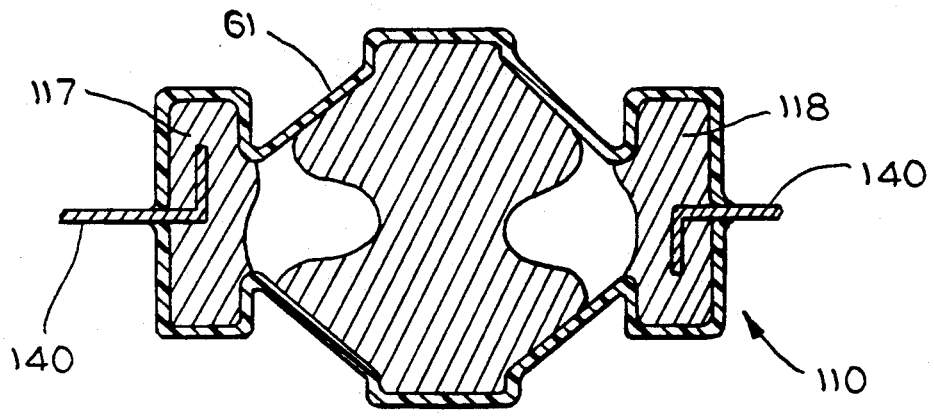
FIG. 29 also shows the fuse of FIG. 23 in an open blown position.

In operation, and referring to FIG. 8, when there is an overload current, the electrical connections 60 deliver heat to the fuse link 18, causing at least one of the solder end walls 27 and 28 to be drawn into the interior of the hollow chamber 20. This is illustrated in a general manner by FIG. 30. With regard to the fuse link 150, a similar situation occurs as is illustrated in FIG. 27. With regard to the fuse link 110, there is a possibility of two scenarios One, where at least one of the entire end wall 117 or 118 is drawn into the hollow chamber 141, FIG. 28, or the second as shown in FIG. 29 where end walls 117 and 118 remain on the fuse and the portion of the fuse link adjacent the weak spots is drawn into the chamber 141.

Generally, the dual element fuse link of FIG. 8 is prepared by molding or electrically attaching fuse link halves 23 and 24 to fuse links 16 and 17 or fuse strips 101 and 106 to prepare the partial fuse links 16A and 17A, FIGS. 15 and 16, the partial fuse strips 101A and 106A, FIGS. 17 and 18. Then the solder cone halves 23 and 24 are appropriately joined together i.e., by welding. The interiors of solder cone halves 23 and 24 are first coated with an appropriate flux prior to being joined together.

After they are joined together, the fuse strips 101A and 106A may be separated into individual dual element fuse links and coated with the silicone or first coated with silicone 61 prior to being separated into individual dual element fuse links.

The dual element fuse is then inserted into a cartridge type fuse wherein one end is soldered at 21′ to terminal 121′ and the other end which has an integral washer is soldered at 21 to terminal 12. The interior of the cartridge is filled with filler through washer opening 87, FIG. 9A, prior to attaching terminal 12 to tube 11.

Whereas the drawings and accompanying description has shown and described preferred embodiments of the present invention, it should be apparent to those skilled in the art that various changes may be made in the form of the invention without affecting the scope thereof.

The invention claimed is:

1. A dual element fuse link comprising a first fuse link section, said first fuse link section having a first end and a second end;

a second fuse link section, said second fuse link section having a first end and a second end;

a third fuse link, said third fuse link section, having a proximal end and a distal end, and said third fuse link having a hollow body defining an interior chamber, said body and said chamber of said third fuse link defining at least one weak spot; said first fuse link section first end being electrically connected to said third fuse link proximal end; and said second fuse link section first end being electrically connected to said third fuse link section distal end.

2. The dual element fuse link of claim 1 wherein said body and chamber of said third fuse link define at least two weak spots.

3. The dual element fuse link of claim 1 wherein a support structure is mounted in said chamber.

4. The dual element fuse link of claim 3 wherein said support structure is a washer means having a diameter dimension larger than a corresponding diameter dimension of said chamber.

5. The dual element fuse link of claim 2 wherein said body has a body distal end, a body proximal end, and a central body portion between said body proximal and distal ends, said body proximal end having a thickness being less than a thickness of said central body portion, a proximal end body thickness being less than said central body thickness, and weak spot cross-sectional areas provided adjacent said distal and proximal body ends.

6. The dual element fuse link of claim 5 wherein an outer face of at least one of said body distal and proximal ends is substantially flat.

7. The dual element fuse link of claim 5 wherein said outer face of both of the body distal and proximal ends are substantially circular and substantially flat.

8. The dual element fuse link of claim 2 wherein said body has first and second body sections, said first section has a first base and a first apex, said first base having a larger diameter than a diameter of said first apex, said first apex outer surface being said proximal end outer face, a main first body section between said first base and said first apex, said main first body section converging from said first base to said first apex, a bore defined by said first section, said first section bore having a first closed end adjacent an interior face of said first apex and a first open end opening through said first base.

9. The dual element fuse link of claim 8 wherein said bore first closed end being smaller than said bore first open end.

10. The dual element fuse link of claim 8 wherein said first base is substantially cylindrical and the outer surface of said main first body section forms a shoulder with said base.

11. The dual element fuse link of claim 10 wherein said first main body section is substantially frustro-conical, said bore has at least a major portion thereof which is substantially frustro-conical with a base of the frustro conical bore being the first open end of the bore.

12. The dual element fuse link of claim 11 wherein a base cross-sectional area of the main section wall adjacent said shoulder is approximately at least 1.75 times the cross-sectional area of the weak spot adjacent said apex.

13. The dual element fuse link of claim 12 wherein the bore is substantially frustro-conical.

14. The dual element fuse link of claim 12 wherein the bore is conical.

15. The dual element fuse link of claim 8 wherein said second body section is substantially identical to said first body section and said second body section is substantially symmetrically and electrically attached to said first body section.

16. The dual element fuse link of claim 15 wherein said first and second body sections are welded at their respective bases.

17. The dual element fuse link of claim 10 wherein said second body section is substantially identical to said first body section and said second body section is substantially symmetrically and electrically attached to said first body section.

18. The dual element fuse link of claim 17 wherein said first and second body sections are welded at their respective bases.

19. The dual element fuse link of claim 12 wherein said second body section is substantially identical to said first body section and said second body section is substantially symmetrically and electrically attached to said first body section.

20. The dual element fuse link of claim 19 wherein said first and second body sections are welded at their respective bases.

21. The dual element fuse link of claim 8 wherein the first and second body sections are composed of an eutectic solder having a melting point of from about 90° C. to about 119° C. and a lead content of less than about 2.0 percent by weight, and the interior of the fuse is coated with a flux coating and an insulative silicone rubber coating is a silicone rubber coating surrounding said third fuse link section and said silicone coating being U.V. curable and having a melting point of great than 150° C.

22. The dual element fuse link of claim 21 wherein said first main body section is substantially frustro-conical, said bore has at least a major portion thereof which is substantially frustro-conical with a base of the frustro conical bore being the first open end of the bore.

23. The dual element fuse link of claim 22 wherein a base cross-sectional area of the main section wall adjacent said shoulder is approximately at least 1.75 times the cross-sectional area of the weak spot adjacent said apex.

24. The dual element fuse link of claim 23 wherein said second body section is substantially identical to said first body section and said second body section is substantially symmetrically and electrically attached to said first body section.

25. A fuse link strip comprising a one-piece strip having a plurality of substantially flat first fuse links having opposite first and second ends, each first fuse link having a plurality of spaced weak spots located along the length thereof, first and second strip feed means interconnecting adjacent first fuse links, said strip feed means extending from opposing sides of said first fuse link adjacent said first fuse link first end, said second strip feed means extending from opposing sides of said first fuse link adjacent said fuse link second end, at least one partial second fuse link electrically connected to at least one first fuse link end, said second fuse link having a body with a body first end and a body second end, a bore formed in said body, said bore having a closed end adjacent said body first end and a second open end opening through said body second end, and said body first end attached to said first fuse link end.

26. The fuse link strip of claim 25 wherein said second fuse link has a conical body section with a base and an apex, said body base having a larger diameter than a diameter of said apex, said bore having a first closed end adjacent an interior face of said first apex and a second open end opening through said base and said first fuse link first end being electrically attached to the apex of said second fuse link.

27. The fuse link strip of claim 26 wherein said bore first closed end being smaller than said bore second open end.

28. The fuse link strip of claim 27 wherein said base is substantially cylindrical and the outer surface of said body section forms a shoulder with said base.

29. The fuse link strip of claim 28 wherein a thickness of the main section wall adjacent said shoulder is approximately at least 1.75 times as thick as a weak spot adjacent said apex.

30. The fuse link strip of claim 28 wherein said second fuse link is substantially composed of solder.

31. The fuse link strip of claim 30 wherein said solder has a melting point of from about 90° C. to about 150° C., and has a lead content of less than 2% by weight.

32. A cylindrical fuse comprising:

a tubular casing, said tubular casing being an electrical insulating material, and said tubular casing having a proximal end and a distal end;

a first terminal attached to said proximal end of said tubular casing;

a second terminal attached to said distal end of said tubular casing;

at least one dual element fuse link disposed within said casing, said at least one dual element fuse link having a first ribbon-like fuse link section, said first fuse link section having a first end and a second end; a second ribbon-like fuse link section, said second fuse link section having a first end and a second end; a third fuse link section, said third fuse link section having a proximal end and a distal end, and said third fuse link section having a body defining an interior chamber, said body and said chamber defining at least one weak spot; said first fuse link section first end being electrically connected to said third fuse link section proximal end; and said second fuse link section first end being electrically connected to said third fuse link section distal end; said first fuse link section second end electrically attached to said first terminal, said second fuse link section second end being electrically attached to said second terminal, said first, second and third fuse link sections being spaced from the interior of said casing.

33. The fuse of claim 32, wherein said third fuse link section includes an insulating coating or housing surrounding said fuse link body and is attached to said first and second fuse link sections, said coating or housing being such that it remains substantially intact when at least one of said third fuse link section proximal and distal ends electrically separates from at least one of said corresponding ends of said first and second fuse links; are quenching filler within said casing surrounding and in contact with said first, second and third fuse link sections.

34. The fuse of claim 32 wherein the body and the chamber define at least two weak spots.

35. The fuse of claim 33 wherein a support structure is mounted in said chamber.

36. The fuse of claim 35 wherein said support structure is a washer means having a diameter dimension larger than a corresponding diameter dimension of said chamber.

37. The fuse of claim 32 wherein the chamber is shaped as a pair of cones joined at their bases with opposite apex ends of the cones being adjacent the ends of the body, said weak spots being adjacent said body ends and a cross-sectional area of said body adjacent said joined chamber bases being at least 1.75 times greater than cross-sectional areas of said weak spots which are adjacent said apex ends.

38. The fuse of claim 37 wherein said third fuse link is constructed from an eutectic solder having less than 2.0% lead, a melting point of from about 90° C. to 150° C., the housing coating is a U.V. curable silicone rubber coating and the interior is coated with a solder flux coating.

39. A fuse link comprising a hollow body, said body having a body distal end, a body proximal end and a central body portion between said body distal and body proximal ends defining an interior chamber; said body having at least one weak spot located adjacent only at least one of said body distal or said proximal ends, wherein said at least one weak spot acts as a circuit interrupter when said fuse link encounters an overload.

40. The fuse link of claim 39 wherein said body and chamber defines at least two weak spots.

41. The fuse link of claim 39 wherein a support structure is mounted in said chamber.

42. The fuse link of claim 41 wherein said support structure is a washer means having a diameter dimension larger than a corresponding diameter dimension of said chamber.

43. The fuse link of claim 40, wherein said body proximal end has a thickness less than a thickness of said central body portion, said distal end has thickness less than a thickness of said central body portion, and at least one weak spot cross-sectional area provided adjacent said distal and proximal body ends.

44. The fuse link of claim 43, wherein an outer face of at least one of said body distal and proximal ends is substantially flat.

45. The fuse link of claim 43, wherein said outer face of both of the body distal and proximal ends are substantially circular and substantially flat.

46. The fuse link of claim 40 wherein said body has first and second body sections, said first section has a first base, and a first apex, said first base having a larger diameter than a diameter of said first apex, said first apex outer surface being said proximal end outer face, a main first body section inclining, said main first body section slanting from said first base to said first apex, a bore defined by said first section, said first section bore having a first closed end adjacent an interior face of said first apex and a first open end opening through said first base.

47. The fuse link of claim 46 wherein said bore first closed end being smaller than said bore first open end.

48. The fuse link of claim 46 wherein said first base is substantially cylindrical and the outer surface of said main first body section forms a shoulder with said base.

49. The fuse link of claim 48 wherein said first main body section is substantially frustroconical, said bore has at least a major portion thereof which is substantially frustroconical with a base of the frustro conical bore being the first open end of the bore.

50. The fuse link of claim 49 wherein a base cross-sectional area of the main section wall adjacent said shoulder is approximately at least 1.75 times the cross-sectional area of the weak spot adjacent said apex.

51. The fuse link of claim 50 wherein the bore is substantially frustro-conical.

52. The fuse link of claim 50 wherein the bore is conical.

53. The fuse link of claim 46, wherein said second body section is substantially identical to said first body section and said second body section is substantially symmetrically and electrically attached to said first body section.

54. The fuse link of claim 53 wherein said first and second body sections are welded at their respective bases.

55. The fuse link of claim 48, wherein said second body section is substantially identical to said first body section and said second body section is substantially symmetrically and electrically attached to said first body section.

56. The fuse link of claim 55 wherein said first and second body sections are welded at their respective bases.

57. The fuse link of claim 50 wherein said second body section is substantially identical to said first body section and said second body section is substantially symmetrically and electrically attached to said first body section.

58. The fuse link of claim 57 wherein said first and second body sections are welded at their respective bases.

59. The fuse link of claim 46 wherein said first and second body sections are substantially composed of solder.

60. The fuse link of claim 59 wherein said solder has a melting point of from about 90° C. to about 150° C., a low electrical resistance.

61. The fuse link of claim 39 having an insulative coating or housing surrounding said fuse link.

62. The fuse link of claim 43 having an insulative coating or housing surrounding said fuse link.

63. The fuse link of claim 44 having an insulative coating or housing surrounding said fuse link.

64. The fuse link of claim 45 having an insulative coating or housing surrounding said fuse link.

65. The fuse link of claim 46 having an insulative coating or housing surrounding said fuse link.

66. The fuse link of claim 57 having an insulative coating or housing surrounding said fuse link.

67. The fuse of claim 60 having an insulative coating or housing surrounding said fuse link.

68. The fuse of claim 37 wherein the cones are frusto-conical cones.

69. The fuse of claim 33 wherein the body and the chamber define at least two weak spots.

70. The fuse of claim 32 wherein said third fuse link section includes an insulating coating or housing surrounding said fuse link body and is attached to said first and second fuse link sections, said coating or housing being such that is remains substantially intact when at least one of said third fuse link section proximal and distal ends electrically separates from at least one of said corresponding ends of said first and second fuse links; are quenching filler within said casing surrounding and in contact with said first, second and third fuse link sections.

71. The fuse of claim 70 wherein said cones are frustro-conical cones.

* * * * *